US008720801B2

(12) United States Patent
Kinoshita et al.

(10) Patent No.: US 8,720,801 B2
(45) Date of Patent: May 13, 2014

(54) SPRAY DEVICE AND PROCESS FOR MANUFACTURING THE SAME

(75) Inventors: Manobu Kinoshita, Yokohama (JP); Kanji Mori, Shimotsuma (JP); Tomio Tsushima, Shimotsuma (JP)

(73) Assignee: Ransburg Industrial Finishing K.K., Kanagawa (JP)

( * ) Notice: Subject to any disclaimer, the term of this patent is extended or adjusted under 35 U.S.C. 154(b) by 1046 days.

(21) Appl. No.: 12/441,339

(22) PCT Filed: Sep. 14, 2007

(86) PCT No.: PCT/JP2007/067953

§ 371 (c)(1), (2), (4) Date: Aug. 6, 2009

(87) PCT Pub. No.: WO2008/032825

PCT Pub. Date: Mar. 20, 2008

(65) Prior Publication Data

US 2010/0032502 A1 Feb. 11, 2010

(30) Foreign Application Priority Data

Sep. 14, 2006 (JP) ..... 2006-249703

(51) Int. Cl.
*B05B 7/02* (2006.01)

(52) U.S. Cl.
USPC ..... 239/526; 239/424.5

(58) Field of Classification Search
CPC ..... B05B 7/02; B05B 7/0423
USPC ..... 239/525, 526, 1; 164/98, 76.1, 108; 264/255, 261, 266
See application file for complete search history.

(56) References Cited

U.S. PATENT DOCUMENTS

| | | | | |
|---|---|---|---|---|
| 2,119,056 | A * | 5/1938 | Peterson | 164/110 |
| 2,991,945 | A * | 7/1961 | Rosenkranz | 239/459 |
| 3,664,888 | A * | 5/1972 | Oga et al. | 148/272 |
| 5,169,068 | A * | 12/1992 | Bertolini | 239/154 |
| 5,803,367 | A | 9/1998 | Heard et al. | |
| 6,681,610 | B2 * | 1/2004 | Yanagibashi et al. | 72/260 |
| 6,949,714 | B2 * | 9/2005 | Kontani et al. | 200/520 |
| 7,104,254 | B2 * | 9/2006 | Arai et al. | 123/376 |
| 7,166,552 | B2 * | 1/2007 | Fukuda et al. | 501/136 |

FOREIGN PATENT DOCUMENTS

| | | |
|---|---|---|
| GB | 657178 | 9/1951 |
| JP | 50115316 A | 9/1975 |
| JP | 52095334 A | 8/1977 |
| JP | 1015442 | 1/1989 |
| JP | 5253656 A | 10/1993 |
| JP | 6190310 | 7/1994 |
| JP | 7070557 | 3/1995 |
| JP | 7275747 | 10/1995 |

(Continued)

*Primary Examiner* — Davis Hwu
(74) *Attorney, Agent, or Firm* — Fletcher Yoder, P.C.

(57) ABSTRACT

A lightweight spray device with spray body that is suitable for precision cast molding, solving general casting problems, such as shrinkage and bubbling; and a process for manufacturing the same. The spray device is one with magnesium spray body provided with a spray part and a handle part, characterized in that the magnesium spray body is one formed with the use of a mold for magnesium spray body wherein a first slide pin is provided at a region where the spray part and the handle part cross each other and wherein around the first slide pin, there is provided a product melt orifice.

20 Claims, 9 Drawing Sheets

(56) References Cited

FOREIGN PATENT DOCUMENTS

| | | |
|---|---|---|
| JP | 7275749 | 10/1995 |
| JP | 9070557 | 3/1997 |
| JP | 9511687 | 11/1997 |
| JP | 10015442 | 1/1998 |
| JP | 11346928 | 12/1999 |
| JP | 2002523214 | 7/2002 |
| JP | 2004321844 | 11/2004 |
| JP | 2006043593 | 2/2006 |
| JP | 200643593 | 9/2007 |
| JP | 2007224078 | 9/2007 |
| JP | 4834804 B2 | 12/2011 |

* cited by examiner

SPRAY DEVICE AND PROCESS FOR MANUFACTURING THE SAME

CROSS REFERENCE TO RELATED APPLICATIONS

This application claims priority to PCT Application No. PCT/JP2007/067953 entitled "SPRAY DEVICE AND METHOD OF MANUFACTURING THE SAME", filed on Sep. 14, 2007, which is herein incorporated by reference in its entirety, and which claims priority to Japanese Patent Application No. 2006-249703, entitled "SPRAY DEVICE AND METHOD OF MANUFACTURING THE SAME", filed on Sep. 14, 2006, which is herein incorporated by reference in its entirety.

FIELD OF THE INVENTION

The present invention relates to a spray device used to spray paint onto a target object and a method of manufacturing the same. More particularly, the present invention relates to a lightweight spray device easy to clean that is suitable for sprinkling liquid like not only paint but also water, adhesives, anti-corrosives, resists, coating liquids, chemicals, or the like, or that is suitable for spraying any of them onto a target object.

BACKGROUND ART

Some of the prior art spray devices will now be described in conjunction with the accompanying drawings, namely, FIGS. 7 to 10, giving a typical example of rotary atomizing spray device (see Patent Document 1 listed below). A rotary atomizer 101 is, as shown in FIG. 7, provided with a handle 110, an adjusting unit 112 above the handle 110, and a spray nozzle 114 at a distal end ahead of the adjusting unit 112.

The handle 110 includes a grip 120 at the bottom of which there are provided an air pipe connector 124 coupling the handle with a high-pressure air pipe 122 conducting to a compressor (not shown), and an air-adjustor thumb screw 126 adjusting pressure of pressurized air supplied to the rotary atomizer 101. As depicted in FIG. 10, the air-adjustor thumb screw 126 displaces a 1st-valve regulator 129 of a first valve 128 to regulate the opening/closing of the first valve 128 that is positioned in a pressurized air duct 127 in communication with the air pipe connector 124.

The adjusting unit 112 is provided, at its center, with a gun body 130, a trigger lever 134 of which rotary shaft links it to a cam lever 132, a hook 136, and a paint pipe connector 140 that is to couple a paint supply pipe 138 conducting to a paint tank (not shown). A spring member 133 urges the cam lever 132 to rotate in clockwise direction in FIG. 7.

The trigger lever 134 is, as can be seen in FIG. 10, pivotally connected to the gun body 130 by means of a trigger-lever rocking member 135. A second valve 137, which is located on the downstream side of the first valve 128 in the context of air flow through the pressurized air duct 127, has its coupling member 150 abutting against the trigger lever 134 at its middle segment. The second valve 137 has a compression spring 139 that urges the trigger lever 134 to pivot forward. A 2nd-valve regulator 151 of the second valve 137 is displaced by the coupling member 150 so as to regulate the opening/closing of the second valve 137.

With the trigger lever 134 being pulled to at the least half of its full back stroke as depicted in FIG. 7, the pressurized air is supplied to an air motor (not shown) to force a bell 206 to revolve. The trigger lever 134 is able to be locked in such a half a back stroke position or ½ back stroke position by engagement of a middle step 148 of a cam 132C in the cam lever 132 with a cam pin 149 that is fixed with the gun body 130.

With the trigger lever 134 being pulled to its full back stroke as depicted in FIG. 8, the pressurized air is further supplied to force the bell 206 revolve and to permit paint to be supplied and atomized, so that the atomized paint can be sprayed through the bell 206. The trigger lever 134 is also able to be locked in such a full back-stroke position by pulling the trigger lever 134 further proximally so as to overcome the repulsive force from the second valve coupling member 150 till the cam pin 149 is engaged with a front end 152 of the cam 132C. In this way, adjusting a position of the cam pin 149 between the middle step 148 and the front end 152 to fix the position in either of them permits the paint to be sprayed with a controlled rate as desired.

In order to release the trigger lever 134, namely, to return it to its home position to bring the spraying to rest, an operator may simply use his or her thumb and press a projection 160 of the trigger lever 134 kept in its ½ back-stroke position as in FIG. 7 so as to rotate the cam lever 132 in the clockwise direction. This allows the cam pin 149 to move from the middle step 162 to the a rear end 164 of the cam 132C, and the trigger lever 134 released from confinement by the cam lever 132 becomes free to retrace its way as shown in FIG. 9.

The adjusting unit 112 is provided, at its upper rear segment, with a sprayed-paint adjustor thumb screw 170 and a shaping-air adjustor thumb screw 172. As shown in FIG. 10, the sprayed-paint adjustor thumb screw 170 alters a relative position of a 3rd-valve regulator 178 of a third valve 176 to the trigger lever 134 where the third valve is located in a paint duct 174 conducting to the paint pipe connector 140. Thus, turning the sprayed-paint adjustor thumb screw 170 permits the paint to be supplied or sprayed with a controlled rate as desired while the trigger lever 134 is being pulled.

The shaping-air adjustor thumb screw 172 displaces a 4th-valve regulator 182 of a fourth valve 180 on the downstream side of the second valve 137 in the pressurized air duct 127, so as to regulate the opening/closing of the fourth valve 180.

The handle 110, generally consisting of the grip 120 and the gun body 130, is fabricated by means of the aluminum die casting, and alternatively, it may be made of die cast aluminum and rigid plastic (see Patent Documents 2 and 3 listed below). The gun body may be molded and/or machined of steels, steel alloys, and/or other substances of tough compositions (see Patent Document 4 listed below). Alternative embodiments have been disclosed like the gun body that is molded of composite resin, as a whole (see Patent Documents 5 and 6), or the one that is made of electrically insulating material suitable for a use of the rotary atomizing and electrostatic coating (see Patent Document 7).

A further alternative embodiment has been disclosed which has an aluminum die cast spray gun body coated with fluorocarbon resin (see Patent Document 8).

Patent Document 1:
Japanese Patent Preliminary Publication of Unexamined Application No. 2004-321844

Patent Document 2:
Japanese Patent Preliminary Publication of Unexamined Application No. H6-190310

Patent Document 3:
Japanese Patent Preliminary Publication of Unexamined Application No. H7-275749

Patent Document 4:
Japanese Patent Preliminary Publication of Unexamined Application No. H9-511687

Patent Document 5:

Japanese Patent Preliminary Publication of Unexamined Application No. 2006-43593

Patent Document 6:

Japanese Patent Preliminary Publication of Unexamined Application No. 2002-523214

Patent Document 7:

Japanese Patent Preliminary Publication of Unexamined Application No. H7-70557

Patent Document 8:

Japanese Patent Preliminary Publication of Unexamined Application No. H7-275747

DISCLOSURE OF THE INVENTION

Problems to be Solved

Even if replaced with a die cast aluminum body, the aforementioned prior art handheld spray devices still have a considerable weight and are significantly heavy for the operator to have to bear so much burden, and there arises a problem that it is hard to continue precision spraying for a long time, which is why a more weight-reduced spray device has been wanted. On the other hand, although the spray device with the body of composite resin is advantageous because it is lightweight, its chemical and mechanical durability is degraded and unsatisfactory for a long-term use under severe conditions and/or as an industrial instrument that is to undergo repetitive washing/cleaning.

In addition, in the case where the spray device employs the prior art design of the aluminum spray body, a process such as the buffing after molded by the die casting, necessary to have its surface polishes the body. Such a polishing process is prone to cause the molded body to have its corners rounded, and this results in the finished surface of the molded body being undesirable in design; in other words, resulting in the reduced freedom of esthetical design.

Object of the Invention

The present invention is made to overcome the aforementioned disadvantages in the prior art spray devices, and accordingly, it is an object of the present invention to provide a lightweight spray device with a spray body that can be molded by means of precision casting without common problems during the casting procedures such as shrinkage and bubbling, and a method of manufacturing the same.

It is another object of the present invention to provide a spray device that has the enhanced chemical and mechanical durability and that facilitates washing/cleaning so as to enable the device to keep the optimum conditions for the extended-term use, and a method of manufacturing the same.

It is still another object of the present invention to provide a spray device and a method of manufacturing the same that permit the greater freedom of design from both the technological and esthetical viewpoints, that, unlike the prior art aluminum die cast spray bodies, eliminate the necessity of having the molding polished by a process such as the buffing, and that allow the molding to undergo processes such as the embossing, the finishing to provide sharpened corners, or the like.

Means for Solving the Prior Art Problems

The present invention is first directed to a spray device that has a magnesium spray body comprised of a spray nozzle and a handle, and the spray device is characterized in that a die used to cast the magnesium spray body has a first slide pin located at an intersection of the spray nozzle and the handle, and a die in-gate through which fused magnesium is injected is defined, surrounding the first slide pin.

In an aspect of the present invention, an embodiment of the spray device can be implemented as follows:

The magnesium spray body has its surface anodized to form anodic oxide coating and then covered with primer coating, and the resultant surface is further covered with fluorocarbon coating.

The die used to cast the magnesium spray body has a second slide pin, and a catch basin is defined, surrounding at least part of the second slide pin.

The magnesium spray body has at least a surface of its handle embossed.

The die used to cast the magnesium spray body has a vacuum chamber conducting to free ends of the spray nozzle and the handle.

The present invention is also directed to a method of manufacturing a spray device that has a magnesium spray body comprised of a spray nozzle and a handle. The method is characterized in that a die used to cast the magnesium spray body has a first slide pin located at an intersection of the spray nozzle and the handle, and a die in-gate through which fused magnesium is injected is defined, surrounding the first slide pin.

In another aspect of the present invention, an embodiment of the method of manufacturing a spray device can be implemented as follows:

The magnesium spray body has its surface anodized to form anodic oxide coating and then covered with primer coating, and the resultant surface is further covered with fluorocarbon coating.

The die used to cast the magnesium spray body has an additional slide pin, and a catch basin is defined, surrounding at least part of the additional slide pin.

The magnesium spray body has at least a surface of its handle embossed.

The die used to cast the magnesium spray body has a vacuum chamber conducting to free ends of the spray nozzle and the handle.

Effects of the Invention

In accordance with the present invention, there can be obtained a lightweight spray device with a spray body that can be molded by means of precision casting without common problems during the casting procedures such as shrinkage and bubbling, and a method of manufacturing such a spray device can also be attained. It has been observed that for similar handheld spray devices of substantially the same arrangements where one has its body made of aluminum and the other of magnesium, the one with the aluminum body is 295 grams in weight while the other with the magnesium body is 245 grams.

The spray device of the present invention or such a spray device obtained by the manufacturing method of the present invention has the enhanced chemical and mechanical durability and facilitates washing/cleaning so as to enable the device to keep the optimum conditions for the extended-term use.

The present invention is furthermore advantageous in that it permits the greater freedom of design from both the technological and esthetical viewpoints, and, unlike the prior art aluminum die cast spray bodies, eliminate the necessity of having the molding polished by a process such as the buffing, and thus, it allow the molding to undergo processes such as the embossing, the finishing to provide sharpened corners, or the like.

BEST MODE OF THE INVENTION

Preferred embodiments of a paint spray device and a method of manufacturing the same according to the present invention will now be described with reference to the accompanying drawings.

An exemplary paint spray device according to the present invention is, as illustrated in FIG. 1, provided with a generally L-shaped spray body 10, a head 12 at a front or distal end of the spray body 10, a trigger lever 14 pivotally attached to the middle of the spray body 10, a divergent spray pattern adjustor knob 16 and a sprayed-paint adjustor knob 18 both of which are attached to the middle of the spray body 10, and a pressurized air adjustor knob 20 and a pressurized air supply aperture 22 both of which are disposed at the rear or proximal bottom of the spray body 10. Also, as can be seen in FIG. 2, the spray body 10 has a paint supply aperture 24 along a distal left side. The spray body 10 is provided with a hook 26 at the distal top by which the paint spray device hangs, and a grip 28 at the lower half and a recess 30 in the grip 28 that the trigger lever 14 works in during its back stroke.

The head 12 is, when viewed facing the front as shown in FIG. 3, provided with a paint ejecting aperture 40 at its center, and two opposite pairs of atomized air blowing apertures 42, 43, 44, 45 outside it, and two additional opposite pairs of divergent spray patterning air apertures 50, 51, 52, 53 further outside of them.

Pressurized air sent through the pressurized air supply aperture 22 has its flow rate appropriately adjusted by the pressurized air adjustor knob 20 and then jetted out through the atomized air blowing apertures 42, 43, 44, 45 and the divergent spray patterning air apertures 50, 51, 52, 53. The divergent spray pattern adjustor knob 16 regulates flow rate and pressure of the pressurized air supplied from the pressurized air supply aperture 22 and jetted out through the divergent spray patterning air apertures 50, 51, 52, 53 so as to control divergence of the spray pattern. The trigger lever 14 cooperative with the sprayed-paint adjustor knob 18 adjusts an amount of the paint sent through the paint supply aperture 24 and interrupts paint supply.

The spray body 10 is fabricated by means of the magnesium die casting or the magnesium alloy die casting. The spray body 10 is cast in a die (not shown) that fits the contours of a green spray body 10C associated with a die in-gate 60 into which fused magnesium is injected, a vacuum chamber 62 urging the fused magnesium to flow through minute clearances of the die, a catch basin 64 for the head 12 that compensates for "shrinkage" due to adverse debris and/or voids developed in the die, a catch basin 65 for the divergent spray pattern adjustor knob 16, a catch basin 66 for the pressurized air supply aperture 22, and a catch basin 67 for the hook 26.

The vacuum chamber 62 leads to a slide-pin hole 70 in the head, a slide-pin hole 73 in the pressurized air adjustor knob, a slide-pin hole 74 in the pressurized air supply aperture, and a projection 77 located at the bottom of the recess 30 in the grip, respectively.

In FIG. 4, for clarifying illustrations of the slide-pin holes 70, 73, and 74, embossed surfaces in the grip 28, the hook 26, and the remaining approximately planar lateral portions of the device, which will be all detailed later, are omitted.

The green spray body 10C cast in the die has the slide-pin hole 70 defined by using a slide pin (not shown) in an area that is to be the head 12. Similarly, the slide-pin hole 71 is defined in an area where the divergent spray pattern adjustor knob 16 is to be located. Also similarly, the slide-pin hole 72 is defined in an area where the sprayed-paint adjustor knob 18 is to be inserted. The slide-pin hole 73 is similarly defined in an area where the pressurized air adjustor knob 20 is inserted. The slide-pin hole 74 is also formed in an area that is to be the pressurized air supply aperture 22. The slide pins (not shown) used as part of the die to give shape to the slide-pin holes 70, 71, 72, 73, 74 in the pre-formation areas respectively corresponding to the head, the divergent spray pattern adjustor knob, the sprayed-paint adjustor knob, the pressurized air adjustor knob, and the pressurized air supply aperture are slid in parallel with the sheet dimensions of FIG. 4, or perpendicular to the sheet dimensions of FIG. 5.

As depicted in FIG. 4, an in-gate 80, which is conducted to the die in-gate 60 by a filling duct 61, surrounds the entire circumference of the slide-pin hole 72 for the sprayed-paint adjustor knob, so as to completely open into the slide-pin hole. Alternatively, the in-gate 80 in communication with the die in-gate 60 via the filling duct 61 does not have to extend along the perfectly entire circumference of the slide-pin hole 72, and instead, it may surround and open into only half a circular extension or any other appropriate arcuate extensions.

The vacuum chamber 62 is in connection with the slide-pin holes 70, 71, and 73 at only the left half of their respective circumferences. These connection areas should not be precisely limited to the left half of the circumferences of the slide-pin holes, and alternatively, the vacuum chamber 62 may be conducting to any other arcuate extensions around the slide-pin holes, allowing for manufacturing costs for the die and/or other factors.

The catch basins 64, 65, 66 respectively shaped in pre-formation areas that are to be the head, the divergent spray pattern adjustor knob, and the pressurized air supply aperture are in connection with the slide-pin holes 70, 71, 74 at the left half of their respective circumferences. A catch basin 67 is in connection with a pre-formation point that is to be the top of the hook 26. The connection areas of the catch basins 64, 65, 66 to the corresponding slide-pin holes 70, 71, 74 respectively shaped in pre-formation areas that are to be the head, the divergent spray pattern adjustor knob, and the pressurized air supply aperture should not be precisely limited to the left half of their respective circumferences, and instead, they may be conducting to any other arcuate extensions around the slide-pin holes, depending on manufacturing costs for the die and/or other factors.

The grip 28, the hook 26, and the remaining approximately planar lateral portions of the device have their respective major surfaces embossed.

As illustrated in FIG. 6, the spray body 10C, after cast and removed from the die, has its die in-gate 60, vacuum chamber 62, and catch basins 64, 65, 66, 67 all cut off. After that, the green spray body 10C has its entire surface polished by means of the buffing, and thus, it is finished in the spray body 10.

Moreover, the spray body 10 further undergoes the anodizing treatment to form anodic oxide coating thereover, and after the primer coating to form undercoat substrate, it is further coated with fluorocarbon. The primer coating enhances bonding effects of the fluorocarbon coating applied thereon. Since magnesium is salt aversive and cannot be plated, the anodic oxidation treatment on the magnesium surface is useful to protect magnesium. One typical example of such an anodic oxidation treatment is non-chrome anode oxidation processing available from Hori Metal Finishing Ind., Ltd. under the trademark " " or ANOMAG. The ANOMAG non-chrome anode oxidation processing effectuates tight bonding with paint, enhances anti-corrosion and insulation properties, and enlarges the possibility to recycle magnesium because of heavy-metal free treatment. The above mentioned primer coating is 10 to 15 micrometers in thickness while the fluorocarbon coating is 30±5 micrometers.

APPLICABILITY IN THE INDUSTRY

The spray device according to the present invention is advantageous for a use as a lightweight and easy-to-clean spray device that is suitable for sprinkling liquid like not only paint but also water, adhesives, anti-corrosives, resists, coating liquids, chemicals, or the like, or that is suitable for spraying any of them onto a target object. The spray device of the present invention also has applications as a static nozzle paint atomizing/coating device and a rotary atomizing/coating device.

DESCRIPTION OF REFERENCE NUMERALS

Figure 1:
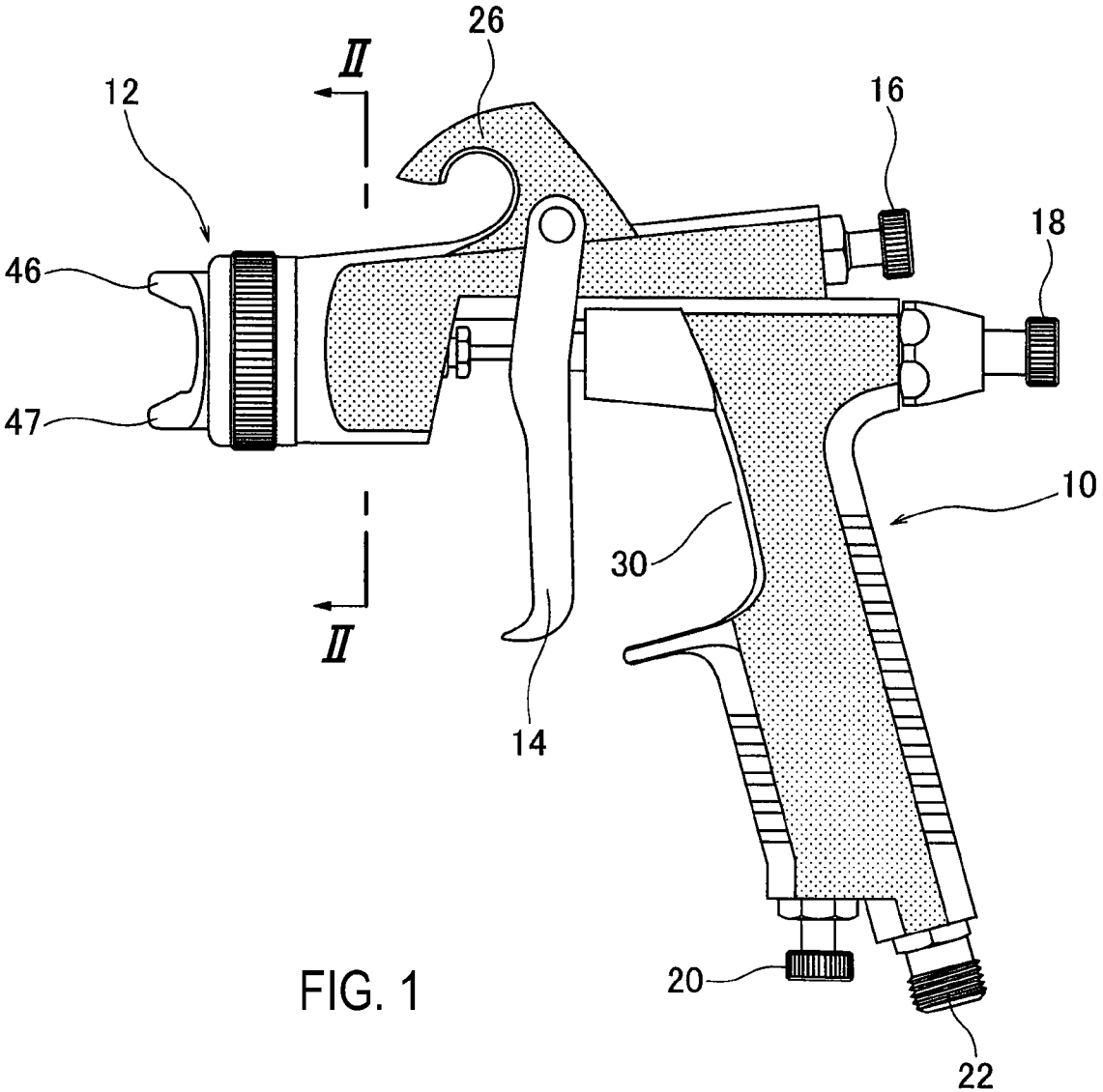
FIG. 1 is a right side view illustrating a preferred embodiment of a paint spray device according to the present invention.
Figure 2:
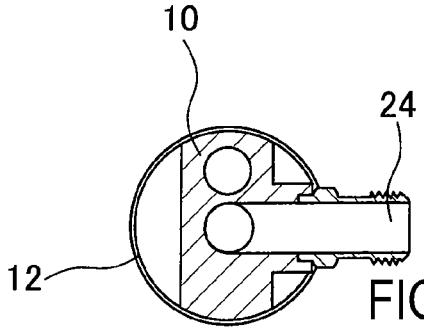
FIG. 2 is a sectional view taken along the line II-II of FIG. 1.
Figure 3:
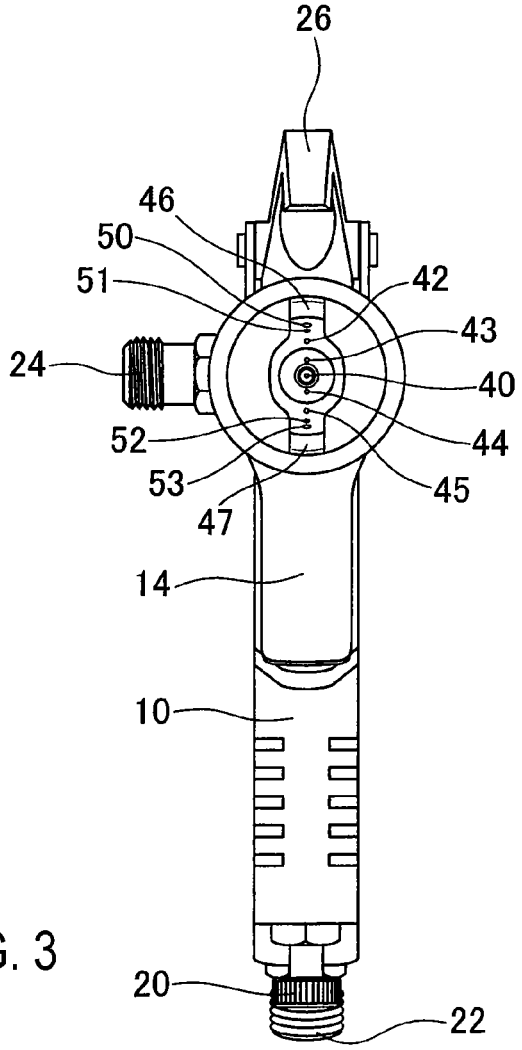
FIG. 3 is a front view illustrating the preferred embodiment of the paint spray device according to the present invention.
Figure 4:
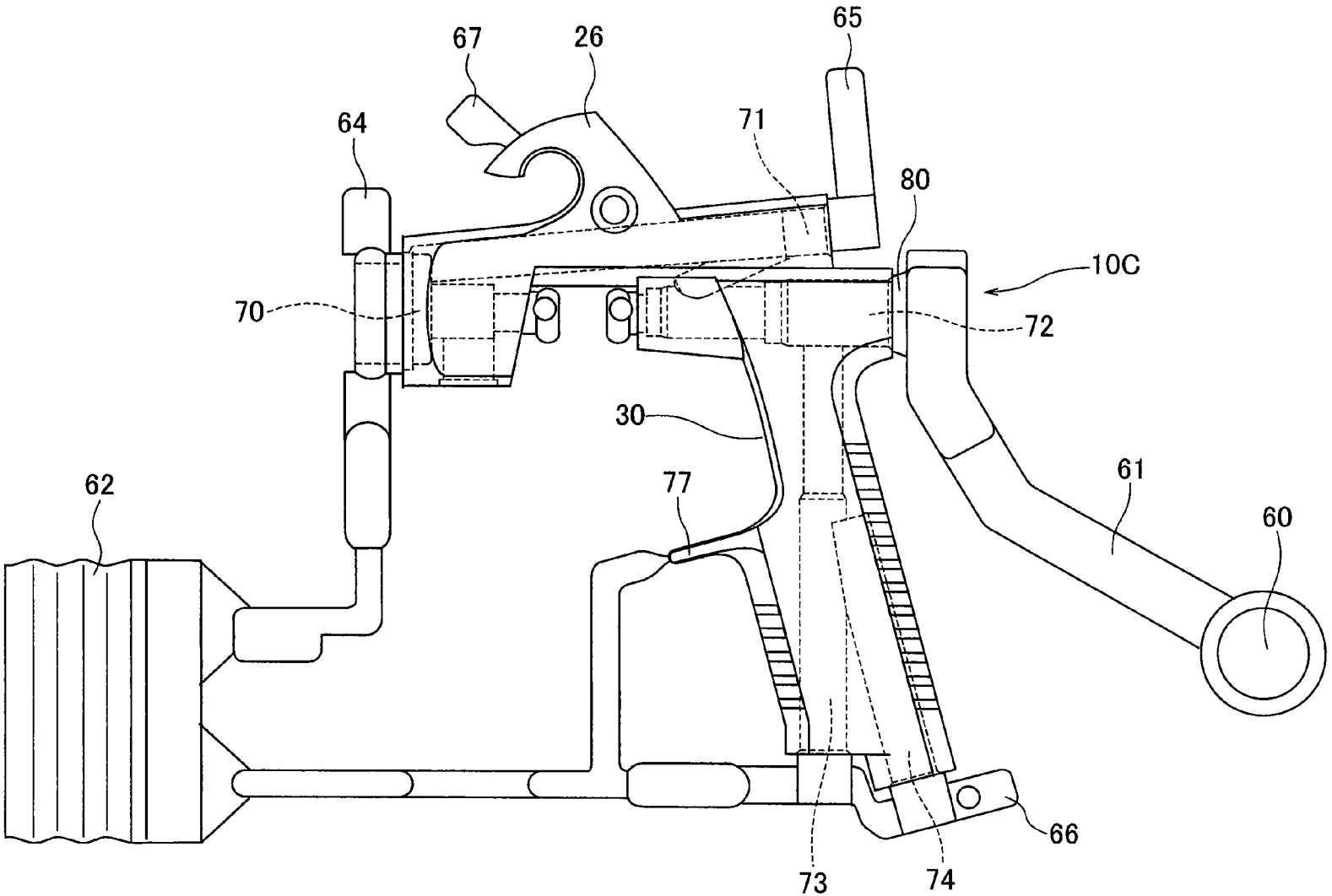
FIG. 4 is a right side view illustrating the molding that is to be a cast spray body of the paint spray device in FIG. 1.
Figure 5:
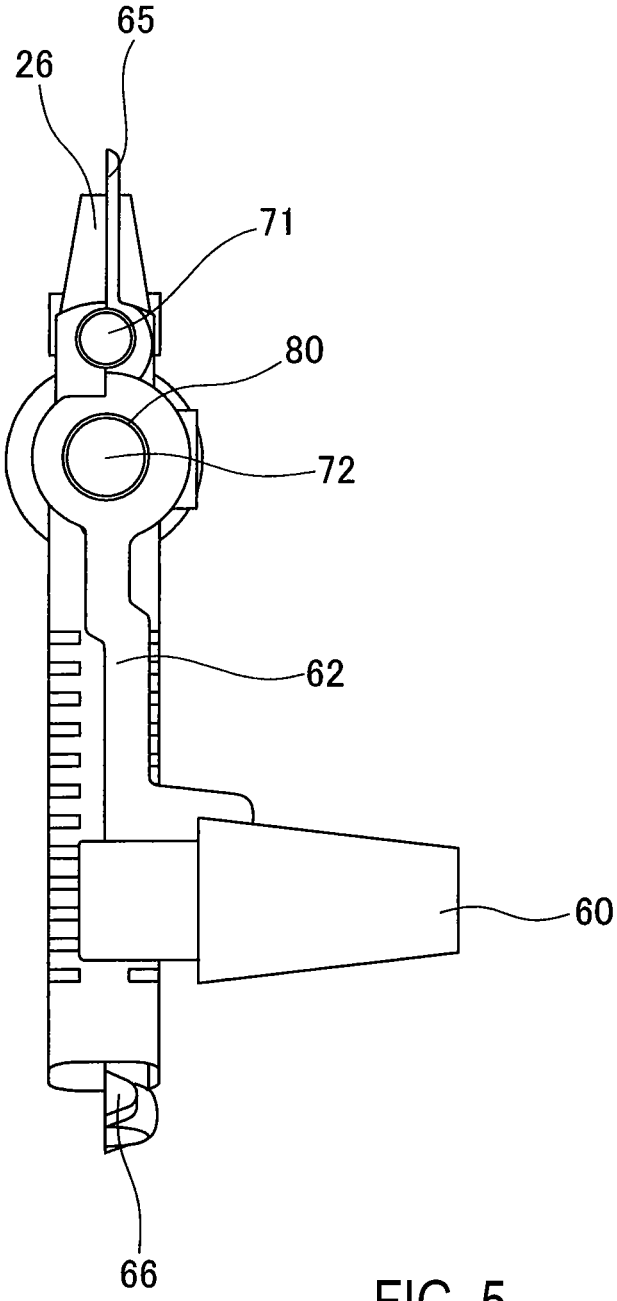
FIG. 5 is a rear view illustrating the molding that is to be the cast spray body of the paint spray device in FIG. 1.
Figure 6:
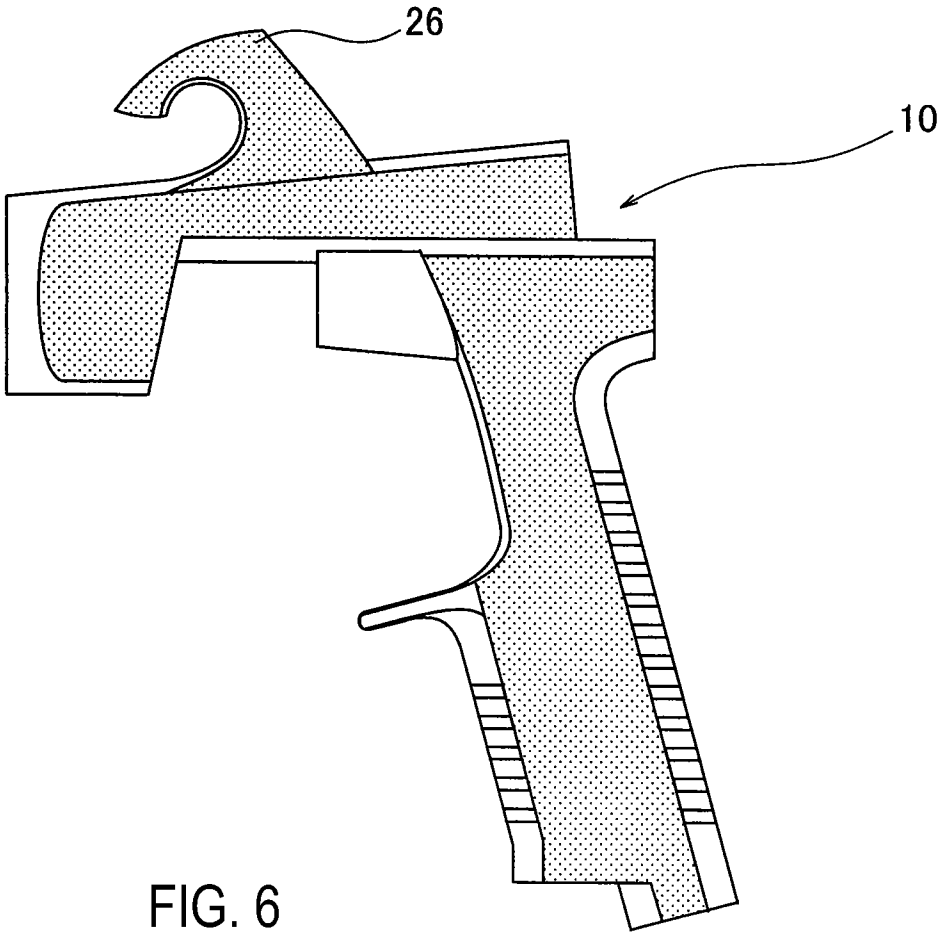
FIG. 6 is a right side view illustrating the molding that has its catch basins and burrs eliminated so as to finish it into the cast spray body of the paint spray device in FIG. 1.
Figure 7:
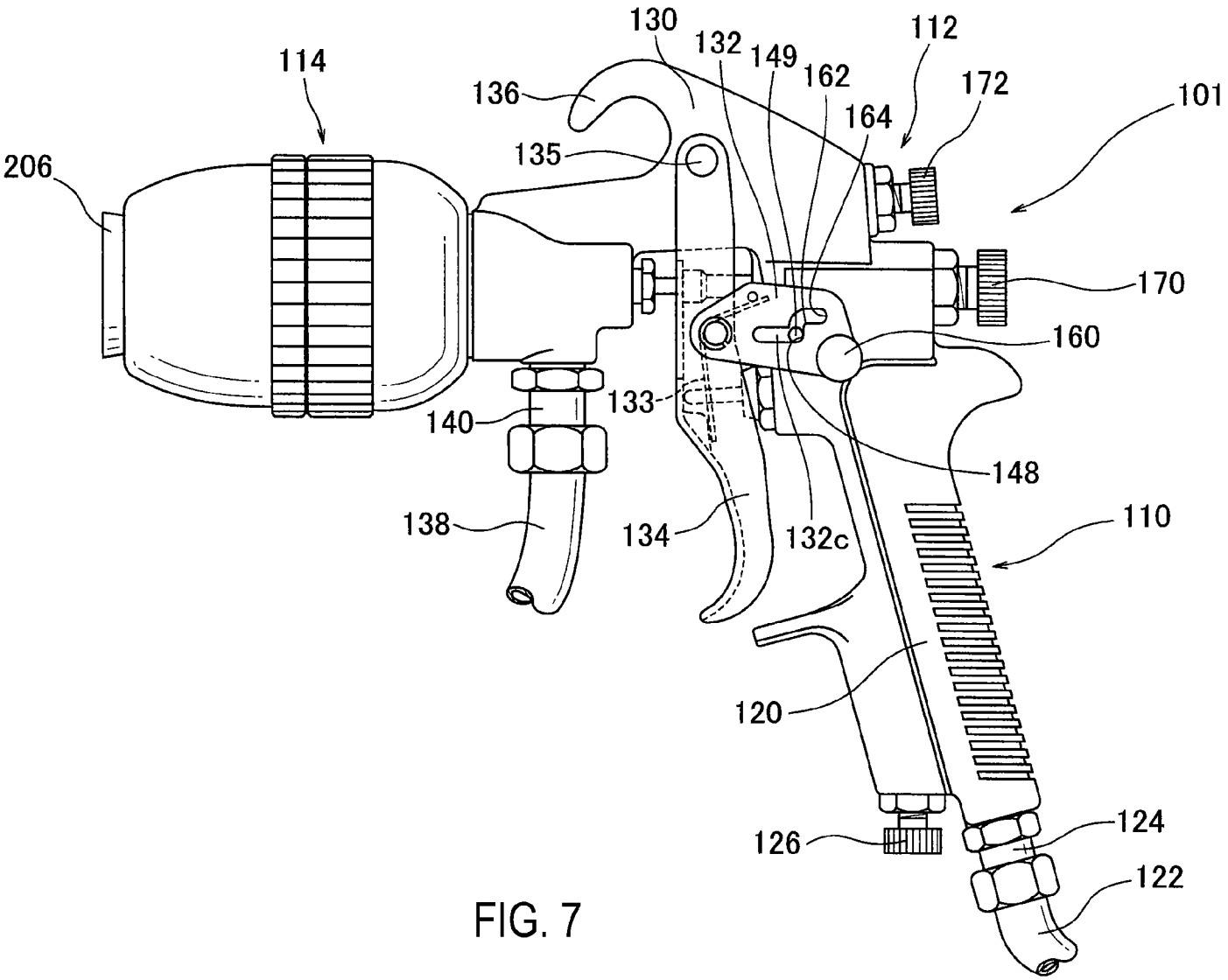
FIG. 7 is a right side view illustrating a prior art rotary spray device that has its trigger lever pulled to half of its full back stroke.
Figure 8:
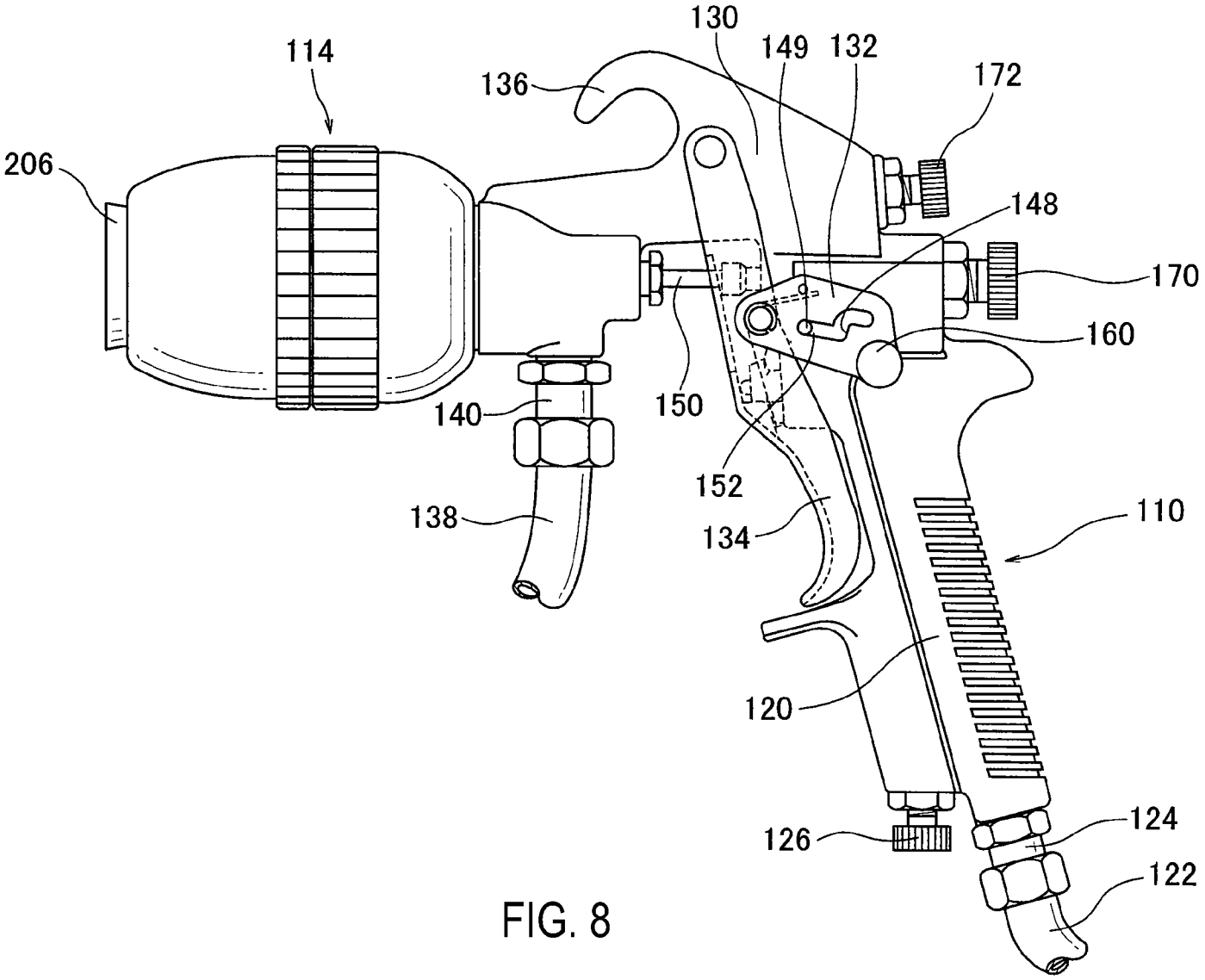
FIG. 8 is a right side view illustrating the rotary spray device in FIG. 7 that has its trigger lever fully pulled proximally.
Figure 9:
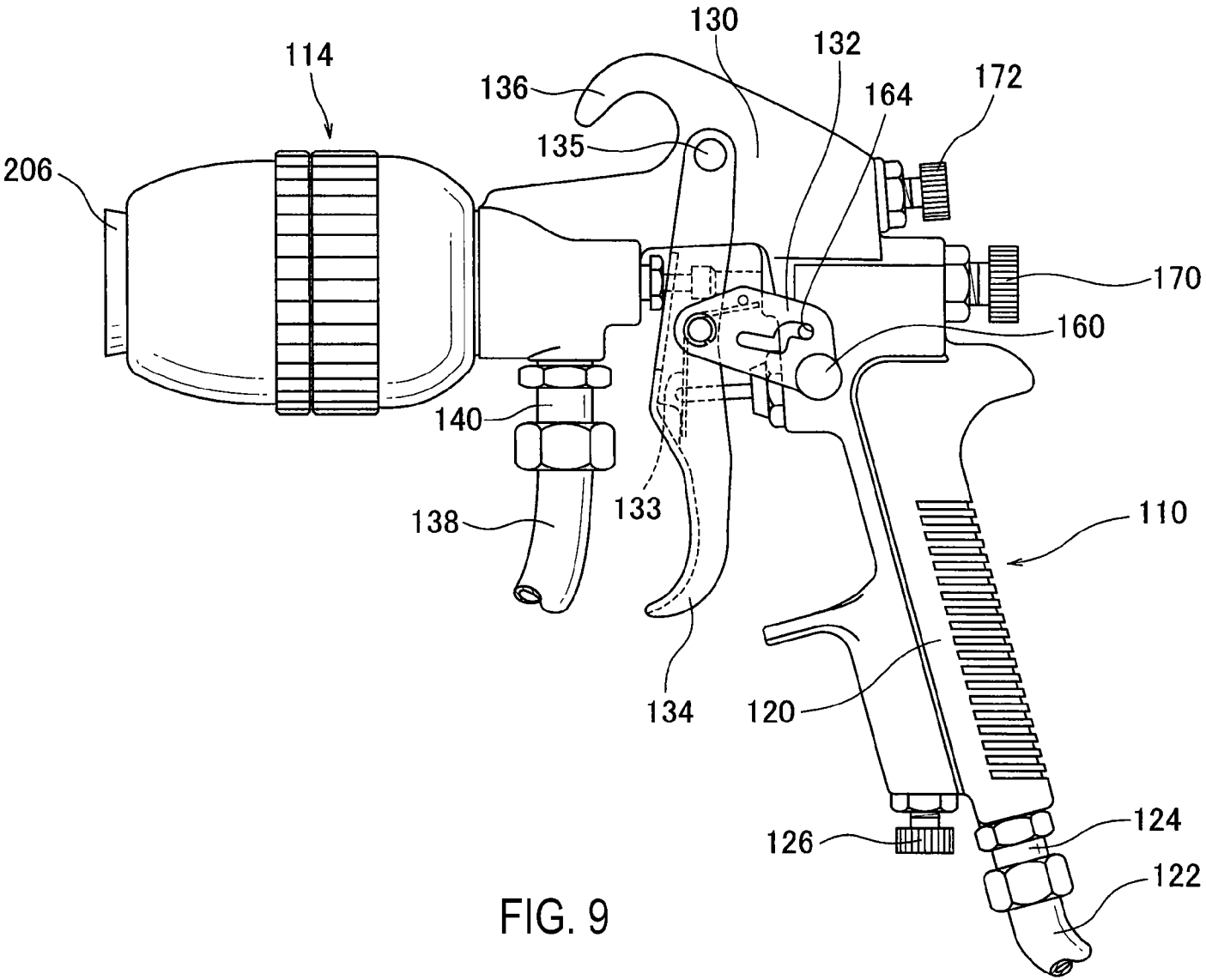
FIG. 9 is a right side view illustrating the rotary spray device in FIG. 7 that has its trigger lever released.
Figure 10:
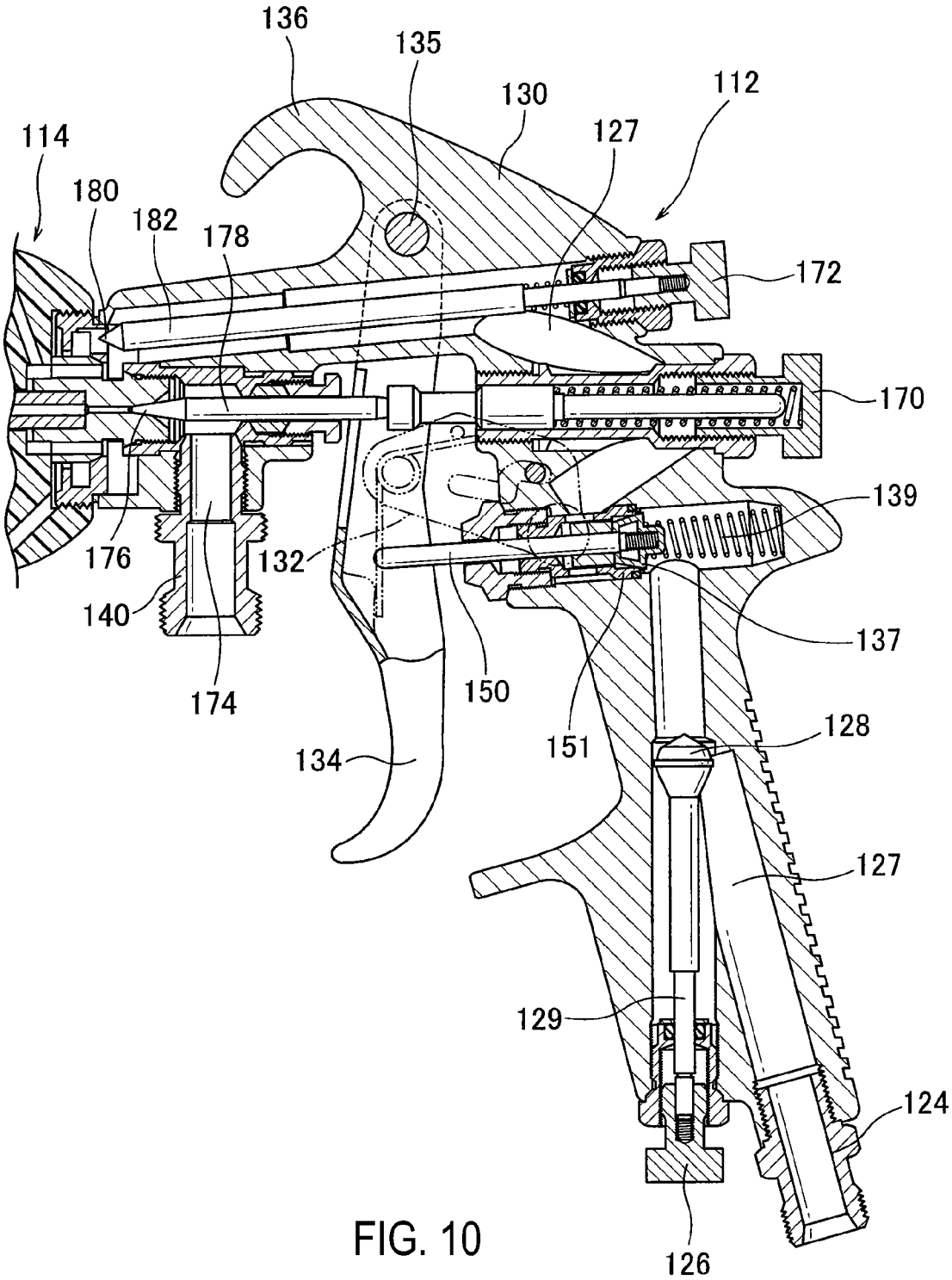
FIG. 10 is a vertical sectional view illustrating a handle and a adjusting unit of the rotary spray device in FIG. 7.

10 Spray Body
10C Molding or Green Spray Body
12 Head
14 Trigger Lever
16 Divergent Spray Pattern Adjustor Knob
18 Sprayed-Paint Adjustor Knob
20 Pressurized Air Adjustor Knob
22 Pressurized Air Supply Aperture
24 Paint Supply Aperture
26 Hook
28 Grip
30 Grip Recess
40 Paint Ejecting Aperture
42, 43, 44, 45 Atomized Air Blowing Apertures
50, 51, 52, 53 Divergent Spray Patterning Air Apertures
60 Die In-Gate
62 Vacuum Chamber
64 Catch Basin in Head Pre-Formation Area
66 Catch Basin in Pressurized Air Supply Aperture Pre-Formation Area
67 Catch Basin in Hook Pre-Formation Area
70 Slide-Pin Hole in the Head
73 Slide-Pin Hole in the Pressurized Air Adjustor Knob
74 Slide-Pin Hole in the Pressurized Air Supply Aperture
77 Projection in the Grip Recess

The invention claimed is:

1. A method, comprising:

supporting a plurality of pins within a die used to form a spray gun body;

filling the die with a material around the plurality of pins to form the spray gun body, wherein the material comprises magnesium; and removing the die from the spray gun body; and removing the plurality of pins from the spray gun body to form an air passage and a liquid passage through the spray gun body, wherein removing the plurality of pins comprises removing first and second pins from respective handle and head portions of the spray gun body to form first and second passages, the first and second passages are coaxial with one another, the first and second passages are offset from one another by an axial distance defined by a gap external to the spray gun body, and the first and second passages are configured to support a valve assembly that extends across the axial distance and through the first and second passages.

2. The method of claim 1, wherein the first and second passages intersect one another at an intersection of the handle and body portions.

3. The method of claim 1, wherein removing the plurality of pins comprises removing the first and second pins from a head portion of the spray gun body to form the liquid passage, and the first and second passages intersect one another within the head portion.

4. The method of claim 1, comprising:

anodizing a surface of the spray gun body to form an anodized surface;

covering the anodized surface with a primer coating to form a primed surface; and covering the primed surface with a fluorocarbon coating.

5. The method of claim 1, wherein filling the die with the material comprises injecting the material internally through the plurality of pins.

6. The method of claim 5, wherein filling the die with the material comprises filling a plurality of catch basins externally coupled to the spray gun body, and removing the die from the spray gun body comprises removing the plurality of catch basins from the spray gun body.

7. The method of claim 1, comprising embossing at least one surface of a handle portion of the spray gun body.

8. A method, comprising:

supporting a plurality of pins within a die used to form a spray gun body;

injecting a material through the plurality of pins to fill the die with the material to form the spray gun body, wherein filling the die with the material comprises filling a plurality of catch basins externally coupled to the spray gun body, and wherein the material comprises magnesium;

removing the die from the spray gun body to form an exterior of the spray gun body, wherein removing the die from the spray gun body comprises removing the plurality of catch basins from the spray gun body; and removing the plurality of pins from the spray gun body to form at least one fluid passage through the spray gun body.

9. The method of claim 8, wherein removing the plurality of pins comprises removing first and second pins from respective handle and body portions of the spray gun body to form an air passage, and the first and second passages intersect one another at an intersection of the handle and body portions.

10. The method of claim 8, wherein removing the plurality of pins comprises removing first and second pins from a head portion of the spray gun body to form a liquid passage, and the first and second passages intersect one another within the head portion.

11. The method of claim 8, wherein removing the plurality of pins comprises removing first and second pins from respective handle and head portions of the spray gun body to form first and second passages, the first and second passages are coaxial with one another, the first and second passages are offset from one another by an axial distance defined by a gap external to the spray gun body, and the first and second passages are configured to support a valve assembly that extends across the axial distance and through the first and second passages.

12. The method of claim 8, comprising:

anodizing a surface of the spray gun body to form an anodized surface;

covering the anodized surface with a primer coating to form a primed surface; and covering the primed surface with a fluorocarbon coating.

13. A system, comprising:

a plurality of pins disposed within a die used to form a spray gun body;

a plurality of catch basins externally coupled to the spray gun body and configured to receive the material, wherein the plurality of catch basins are removable from the spray gun body; and a material around the plurality of pins in the die to form the spray gun body, wherein the material comprises magnesium, the die is removable to uncover an exterior of the spray gun body, and the plurality of pins are removable to form an air passage and a liquid passage through the spray gun body.

14. The system of claim 13, wherein the plurality of pins includes a first pin disposed in a handle portion of the spray gun and a second pin disposed in a body portion of the spray gun body, and the first and second pins intersect one another at an intersection of the handle and body portions.

15. The system of claim 13, wherein the spray gun body has an anodized exterior surface, a primer coating disposed over the anodized exterior surface, and a fluorocarbon coating disposed over the primer coating.

16. The system of claim 13, wherein a portion of an exterior of the spray gun body is embossed.

17. The system of claim 13, comprising a vacuum chamber coupled to a head portion and a handle portion of the spray gun body.

18. A system, comprising:

a plurality of pins disposed within a die used to form a spray gun body; and a material around the plurality of pins in the die to form the spray gun body, wherein the material comprises magnesium, the die is removable to uncover an exterior of the spray gun body, and the plurality of pins are removable to form an air passage and a liquid passage through the spray gun body, wherein the plurality of pins comprise a first and second pin disposed in respective handle and head portions of the spray gun body, the first and second pins define first and second passages, and wherein the first and second passages are coaxial with one another, the first and second passages are offset from one another by an axial distance defined by a gap external to the spray gun body, and the first and second passages are configured to support a valve assembly that extends across the axial distance and through the first and second passages.

19. A system, comprising:

a magnesium spray gun body defining an exterior surface and comprising first and second passages and disposed in respective handle and head portions of the spray gun body and defining interior surfaces of the spray gun body, wherein:

the first the first and second passages are coaxial with one another;

the first and second passages are offset from one another by an axial distance defined by a gap external to the spray gun body;

the first and second passages are configured to support a valve assembly that extends across the axial distance and through the first and second passage; and the exterior and interior surfaces are covered in an anodized surface, a primer coating is disposed over the anodized surface, and a fluorocarbon coating is disposed over the primer coating.

20. The system of claim 19, wherein the first and second passages intersect one another at an intersection of the handle and body portions.

* * * * *